US010944205B2

(12) United States Patent
Chen et al.

(10) Patent No.: US 10,944,205 B2
(45) Date of Patent: Mar. 9, 2021

(54) HERMETIC ELECTRICAL ADAPTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: De-Jin Chen, Kunshan (CN); Xing-Liang Liu, Kunshan (CN); Shih-Wei Hsiao, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/595,509

(22) Filed: Oct. 8, 2019

(65) Prior Publication Data

US 2020/0112119 A1 Apr. 9, 2020

(30) Foreign Application Priority Data

Oct. 8, 2018 (CN) ..... 201811166231.4

(51) Int. Cl.
*H01R 13/52* (2006.01)
*H01R 12/70* (2011.01)
(Continued)

(52) U.S. Cl.
CPC ..... *H01R 13/521* (2013.01); *H01R 12/7005* (2013.01); *H01R 12/716* (2013.01);
(Continued)

(58) Field of Classification Search
CPC ..... H01R 12/7005; H01R 12/716; H01R 13/502; H01R 13/514; H01R 13/521; H01R 13/6585; H01R 24/60; H01R 2107/00
(Continued)

(56) References Cited

U.S. PATENT DOCUMENTS 4,126,840 A * 11/1978 Selvin ..... H01R 13/7195 333/175
5,118,312 A * 6/1992 Lu ..... H01R 13/64 439/218
(Continued)

FOREIGN PATENT DOCUMENTS

CN 207572564 7/2018

*Primary Examiner* — Abdullah A Riyami
*Assistant Examiner* — Vladimir Imas
(74) *Attorney, Agent, or Firm* — Wei Te Chung; Ming Chieh Chang

(57) ABSTRACT

A hermetic electrical adaptor including a first insulative body, a second insulative body, a plurality of contacts, a first glue body and a second glue body. The contact has a main body and first and second contacting sections located at two opposite ends of the main body. The first insulative body has a first base and a first tongue, and the second insulative body has a second base and a second tongue. The second base forms a receiving cavity to receive the first base. The first contacting section is disposed upon the first tongue, and the second contacting section is disposed upon the second tongue. The first insulative body is integrally formed with the contacts as a contact module before assembled with the second insulative body. The first base forms in a back side a receiving space to receive the first glue body.

17 Claims, 12 Drawing Sheets

(51) Int. Cl.

| | |
|---|---|
| ***H01R 12/71*** | (2011.01) |
| ***H01R 24/60*** | (2011.01) |
| ***H01R 13/514*** | (2006.01) |
| ***H01R 13/502*** | (2006.01) |
| ***H01R 13/6585*** | (2011.01) |
| *H01R 107/00* | (2006.01) |

(52) U.S. Cl.
CPC ..... *H01R 13/502* (2013.01); *H01R 13/514* (2013.01); *H01R 13/6585* (2013.01); *H01R 24/60* (2013.01); *H01R 2107/00* (2013.01)

(58) Field of Classification Search
USPC ..... 439/271
See application file for complete search history.

(56) References Cited

U.S. PATENT DOCUMENTS 6,511,329 B2 * 1/2003 Yi-Tsung ..... H01R 13/52 439/701
6,805,665 B1 * 10/2004 Tatsuno ..... A61B 1/05 600/101
7,375,533 B2 * 5/2008 Gale ..... H01R 31/06 324/538
7,387,520 B2 * 6/2008 Gosling ..... H01R 25/164 439/215
7,670,060 B2 * 3/2010 Ziemke ..... G02B 6/3893 385/55
7,891,990 B1 * 2/2011 Gao ..... H01R 13/504 439/79
7,938,652 B2 * 5/2011 Yang ..... H01R 12/716 439/81
8,257,107 B2 * 9/2012 Tsuruta ..... H01R 13/6581 439/362
8,376,606 B2 * 2/2013 Yu ..... F21V 17/06 362/652
8,491,323 B2 * 7/2013 Ishibashi ..... H01R 13/5221 439/205
8,738,097 B2 * 5/2014 Hong ..... H01R 13/5202 455/575.1
8,827,742 B2 * 9/2014 Wang ..... H01R 24/68 439/569
9,112,296 B2 * 8/2015 Zhang ..... H01R 13/516
9,385,484 B2 * 7/2016 Chen ..... H01R 13/6594
9,397,438 B2 * 7/2016 Chen ..... H01R 13/5202
9,429,360 B2 * 8/2016 Hsiao ..... F26B 3/28
9,461,408 B1 * 10/2016 Yan ..... H01R 31/065
9,490,594 B2 * 11/2016 Little ..... H01R 24/60
9,537,248 B2 * 1/2017 Hung ..... H01R 13/502
9,742,098 B2 * 8/2017 Zhao ..... H01R 13/5202
9,768,567 B2 * 9/2017 Cheng ..... H01R 24/60
9,825,398 B1 * 11/2017 Uchida ..... H01R 13/5219
9,893,459 B2 * 2/2018 Zhao ..... H01R 13/5219
9,991,628 B2 * 6/2018 Daoura ..... H01R 13/6205
10,074,935 B2 * 9/2018 Kato ..... H01R 13/6315
10,109,948 B2 * 10/2018 Zhao ..... H01R 13/5219
10,177,488 B2 * 1/2019 Zhao ..... H01R 13/5219
10,199,763 B2 * 2/2019 Zhu ..... H01R 13/5202
10,355,394 B2 * 7/2019 Zhang ..... H01R 13/521
10,355,396 B2 * 7/2019 Zhao ..... H01R 13/6582
10,468,827 B2 * 11/2019 Chen ..... H01R 4/02
10,608,358 B2 * 3/2020 Hou ..... H01R 13/506
2002/0115344 A1 * 8/2002 Chen ..... H01R 13/5219 439/587
2002/0146937 A1 * 10/2002 Yi-Tsung ..... H04M 1/0274 439/587
2009/0053913 A1 * 2/2009 Chen ..... H01R 12/716 439/81
2013/0183844 A1 * 7/2013 Wang ..... H01R 24/68 439/271
2015/0155661 A1 * 6/2015 Chen ..... H01R 13/6582 439/607.01
2017/0162975 A1 * 6/2017 Tsai ..... H01R 24/60
2017/0250495 A1 * 8/2017 Yudate ..... H01R 13/5202

* cited by examiner

HERMETIC ELECTRICAL ADAPTOR

BACKGROUND OF THE INVENTION

1. Field of the Invention

The present invention relates generally to an electrical adaptor having two opposite mating tongues for connecting two opposite connectors having the similar mating space, and particularly to the hermetic electrical adaptor.

2. Description of Related Arts

China Utility Patent No. CN207572564U discloses a pair of board-to-board connectors having complementary mating interfaces for mating with each other and respectively mounted upon two opposite printed circuit boards (PCBs) for electrically connecting these two PCBs. Anyhow, in some situations it requires to have an adaptor connecting two opposite connectors having the similar mating interface.

It is desirable to provide an electrical adaptor for connecting two electrical connector having the similar mating space, and particularly to provide a hermetic electrical adaptor so as not to affect the in-and-out signal transmission.

SUMMARY OF THE INVENTION

An object of the invention is to provide a hermetic electrical adaptor including a first insulative body, a second insulative body, a plurality of contacts, a first glue body and a second glue body. The contact has a main body and first and second contacting sections located at two opposite ends of the main body. The first insulative body and the second insulative body are back to back assembled to each other. The first insulative body has a first base and a first tongue, and the second insulative body has a second base and a second tongue. The second base forms a receiving cavity to receive the first base. The first contacting section is disposed upon the first tongue, and the second contacting section is disposed upon the second tongue. The first insulative body is integrally formed with the contacts as a contact module before assembled with the second insulative body. The first base forms in a back side a receiving space to receive the first glue body. The second glue body is disposed in the receiving cavity to surround the first base.

DETAILED DESCRIPTION OF THE PREFERRED EMBODIMENT

Figure 1:
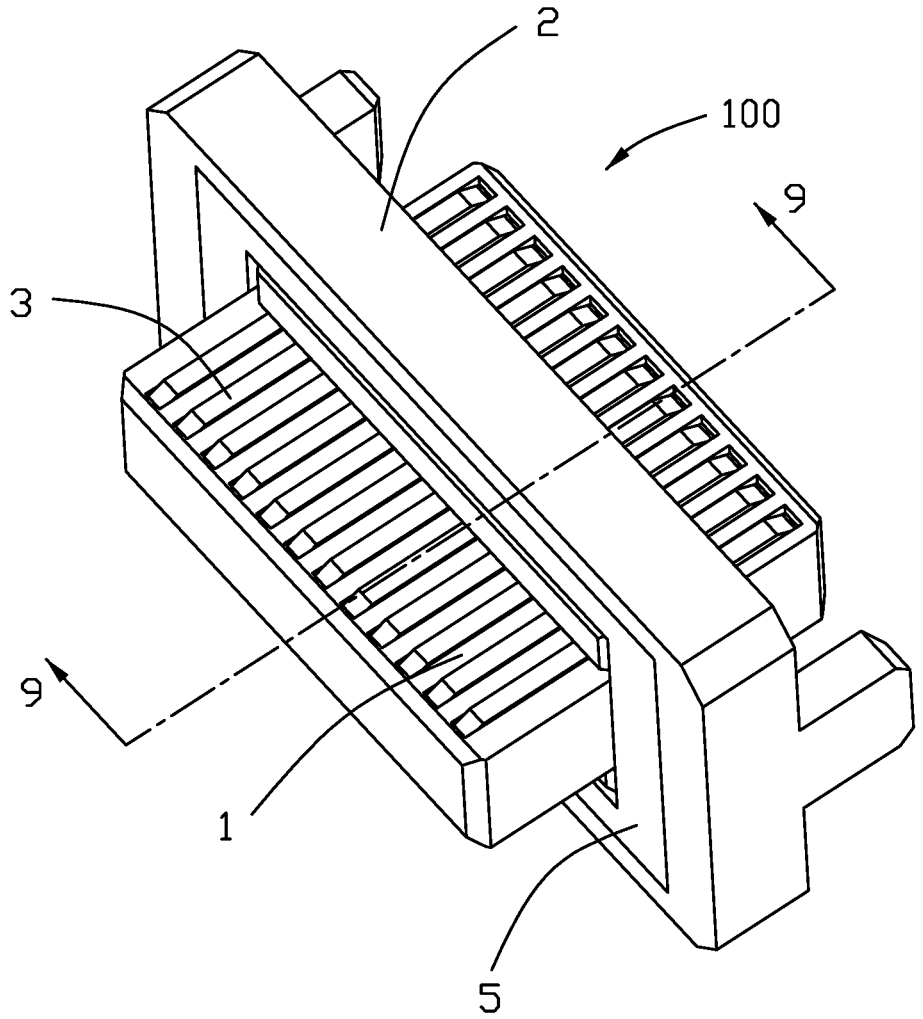
FIG. 1 is a perspective view of a hermetic electrical adaptor according to a first embodiment of the invention.
Figure 2:
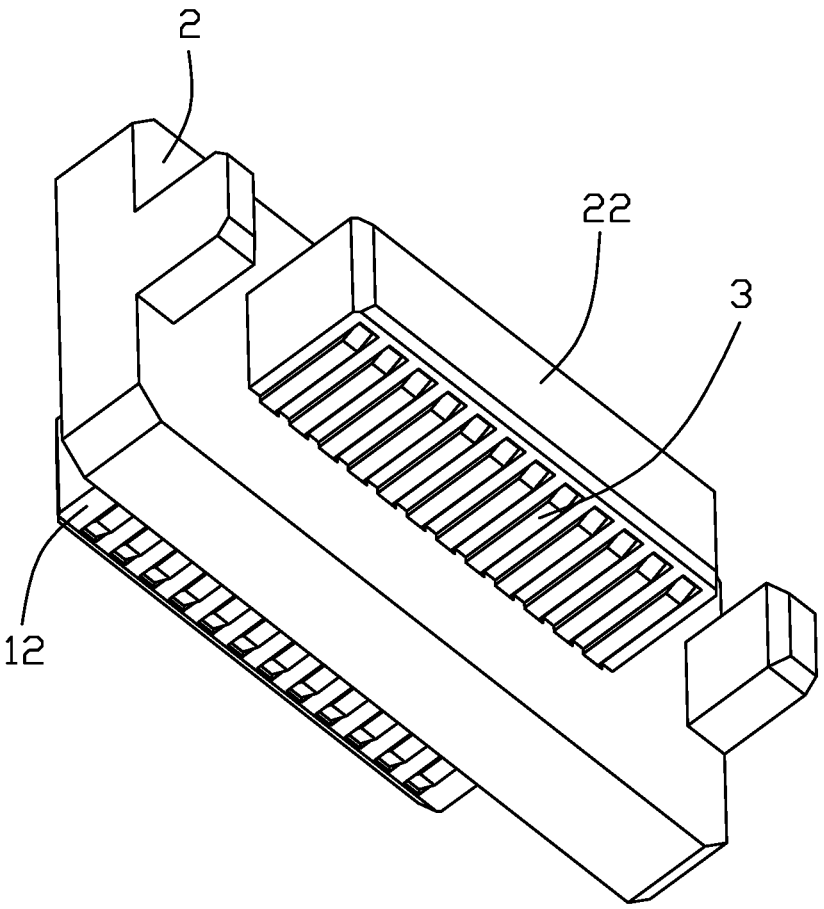
FIG. 2 is another perspective view of the hermetic electrical adaptor of FIG. 1.
Figure 3:
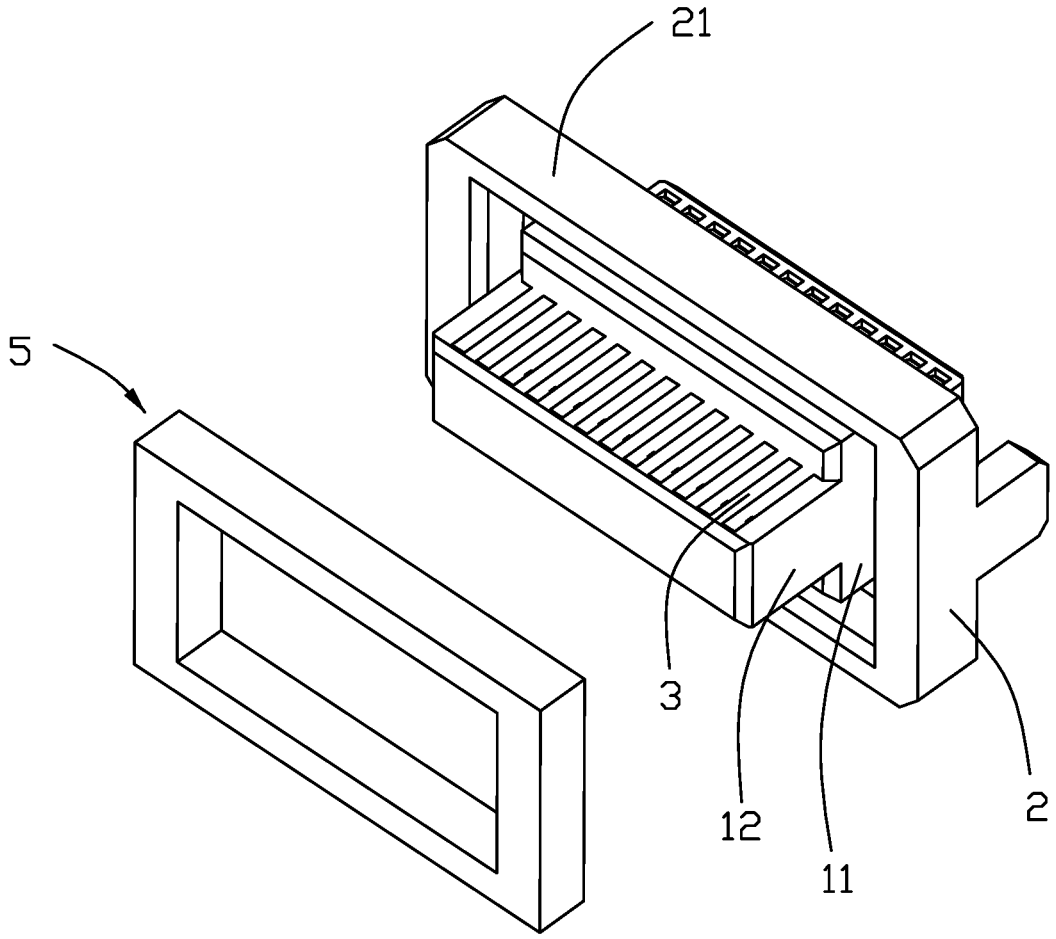
FIG. 3 is an exploded perspective view of the hermetic electrical adaptor of FIG. 1.
Figure 4:
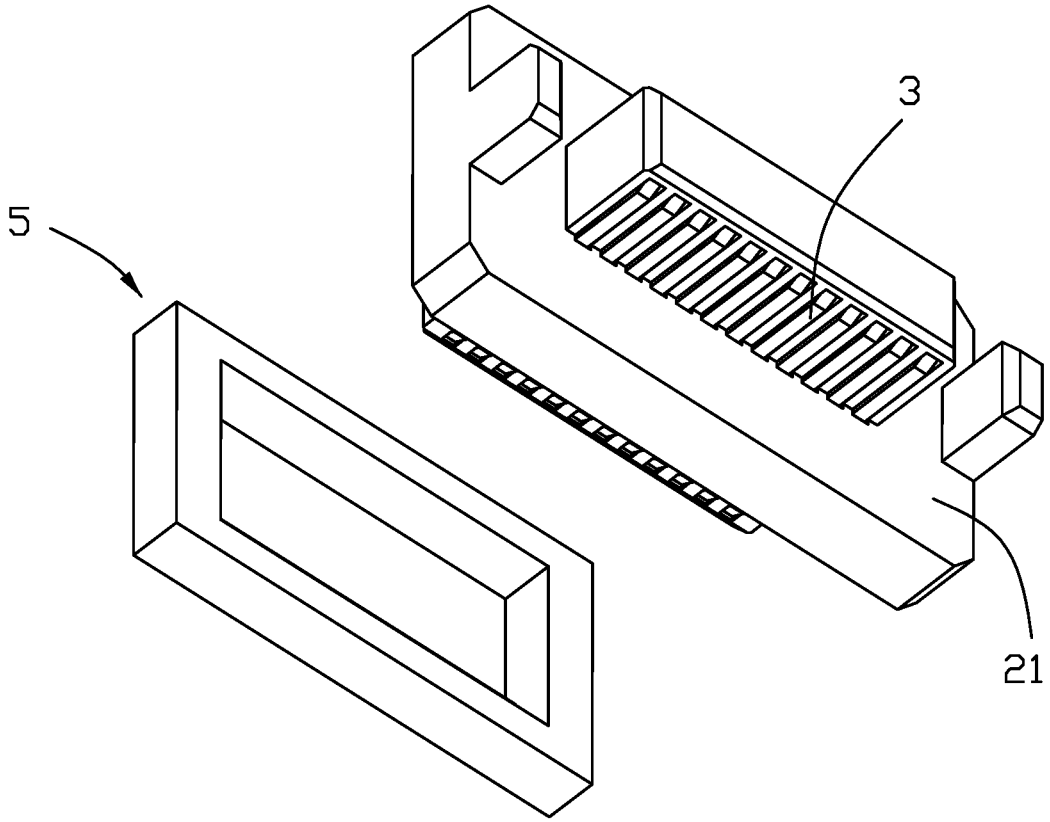
FIG. 4 another exploded perspective view of the hermetic electrical adaptor of FIG. 3.
Figure 5:
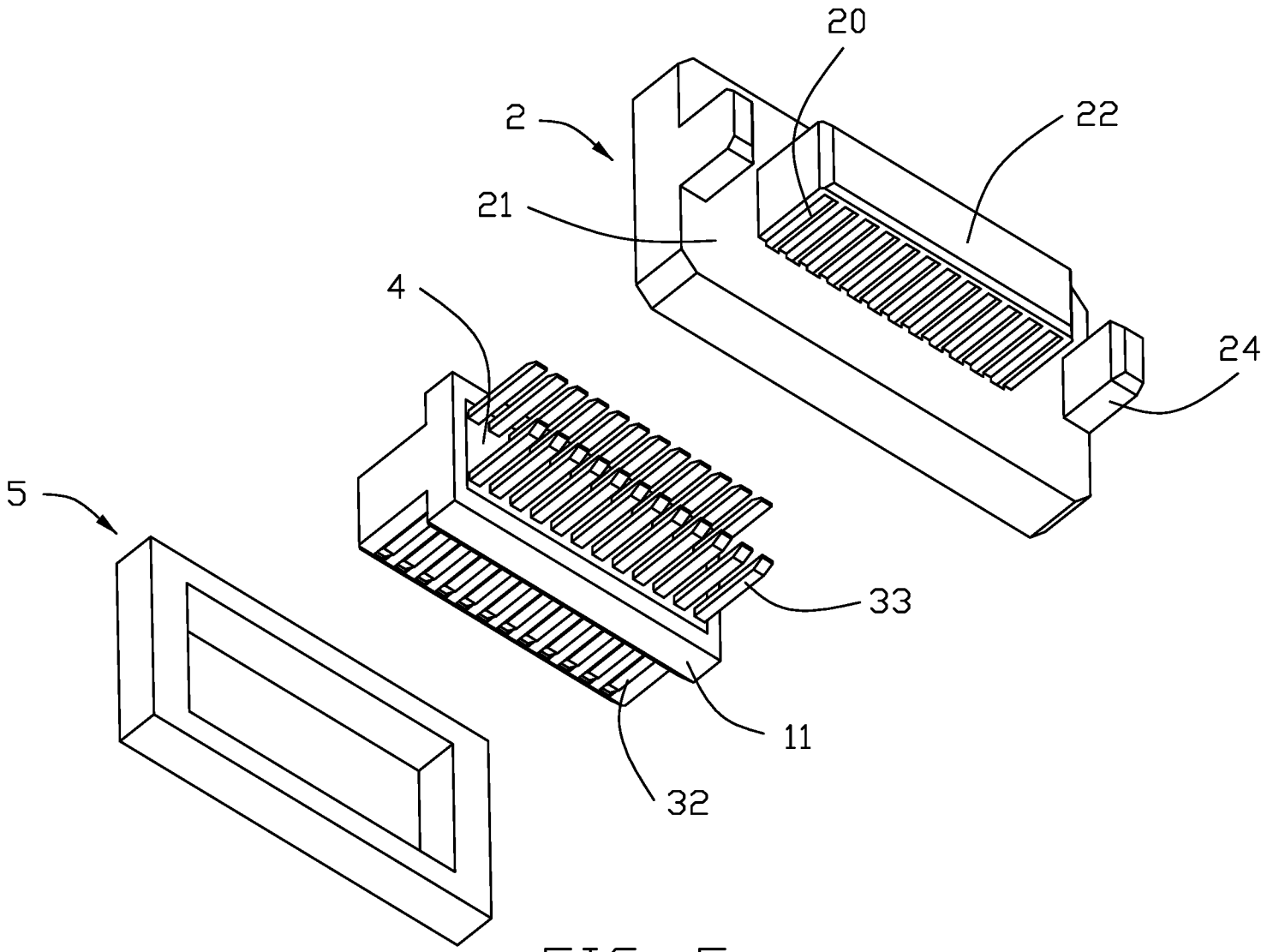
FIG. 5 is a further exploded perspective view of the hermetic electrical adaptor of FIG. 3.
Figure 6:
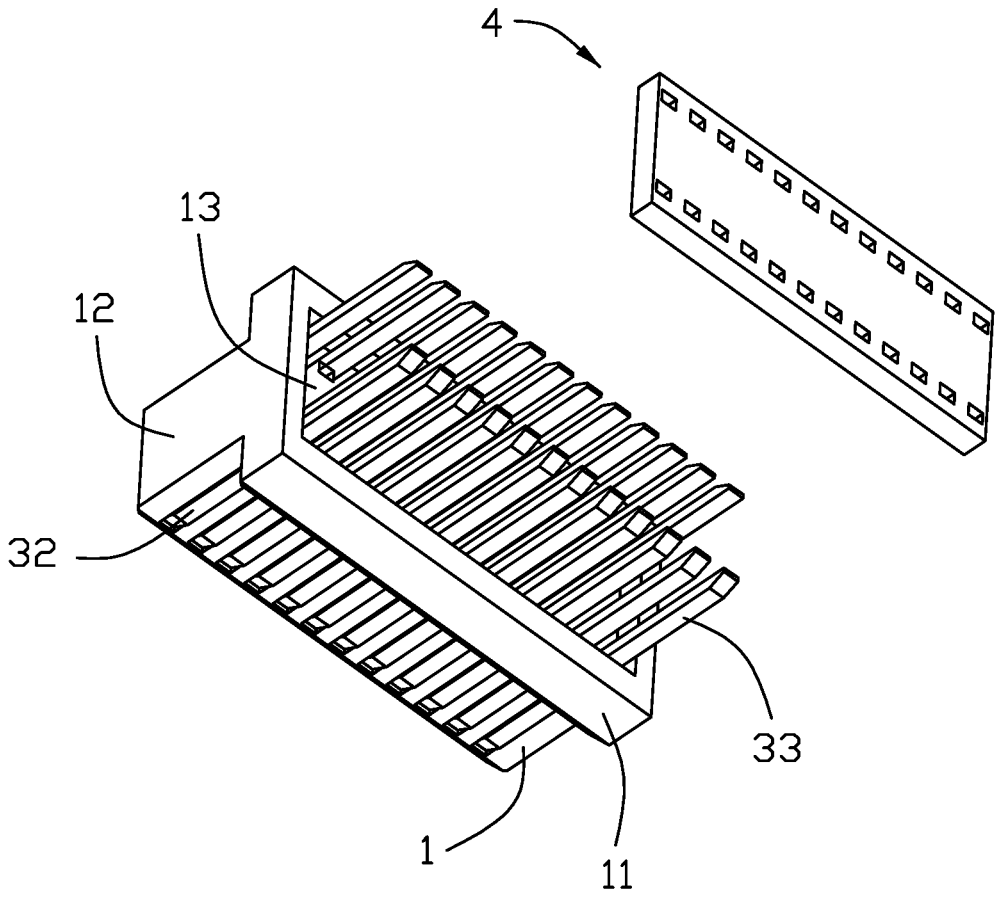
FIG. 6 is another exploded perspective view of the hermetic electrical adaptor of FIG. 5.
Figure 7:
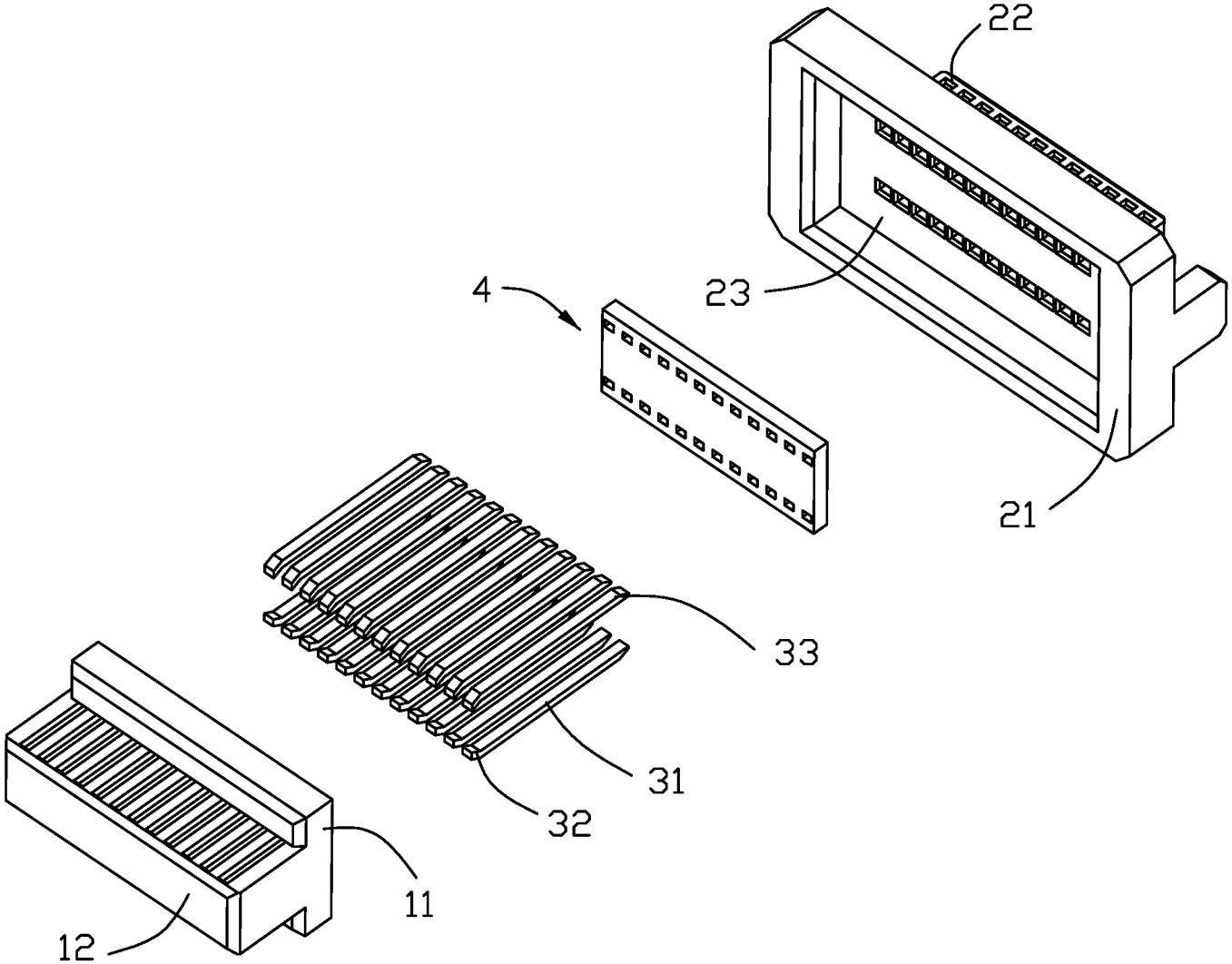
FIG. 7 is a further exploded perspective view of the hermetic electrical adaptor of FIG. 5.
Figure 8:
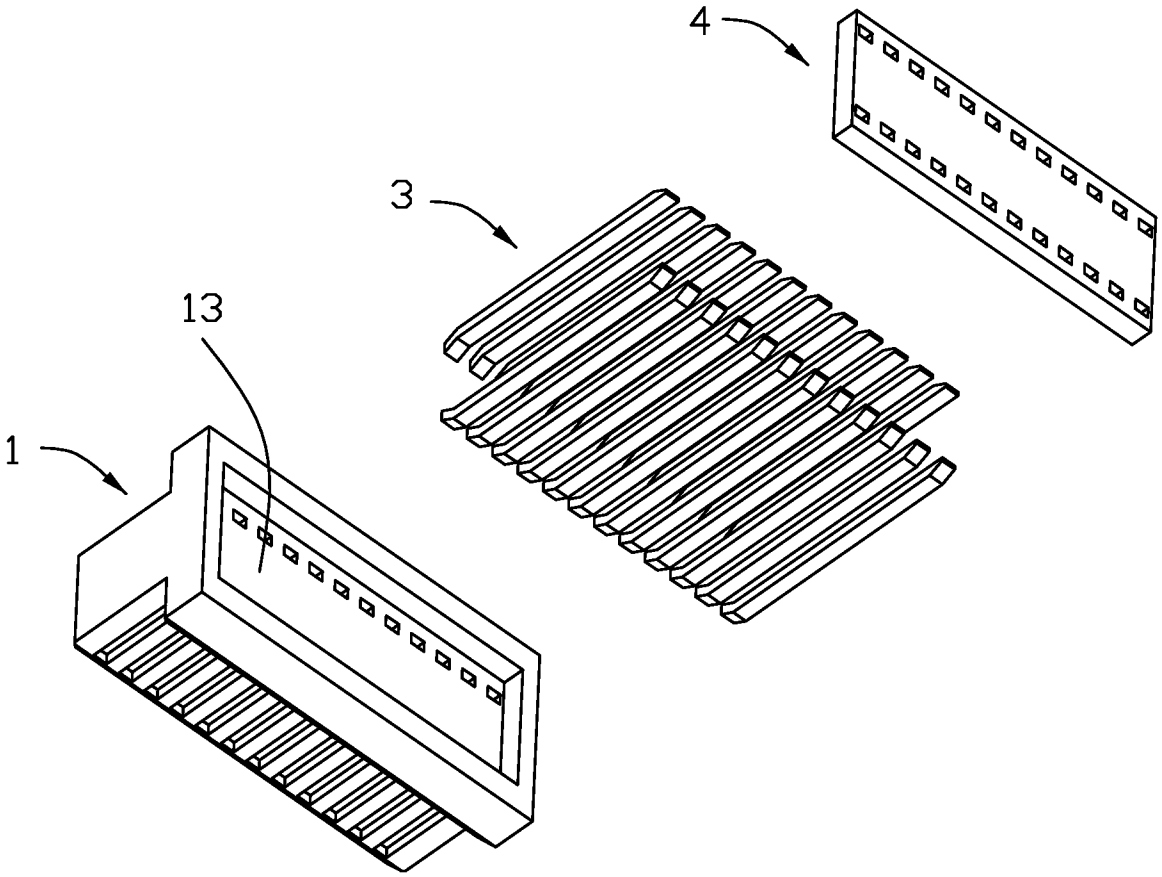
FIG. 8 is another exploded perspective view of the hermetic electrical adaptor of FIG. 7.
Figure 9:
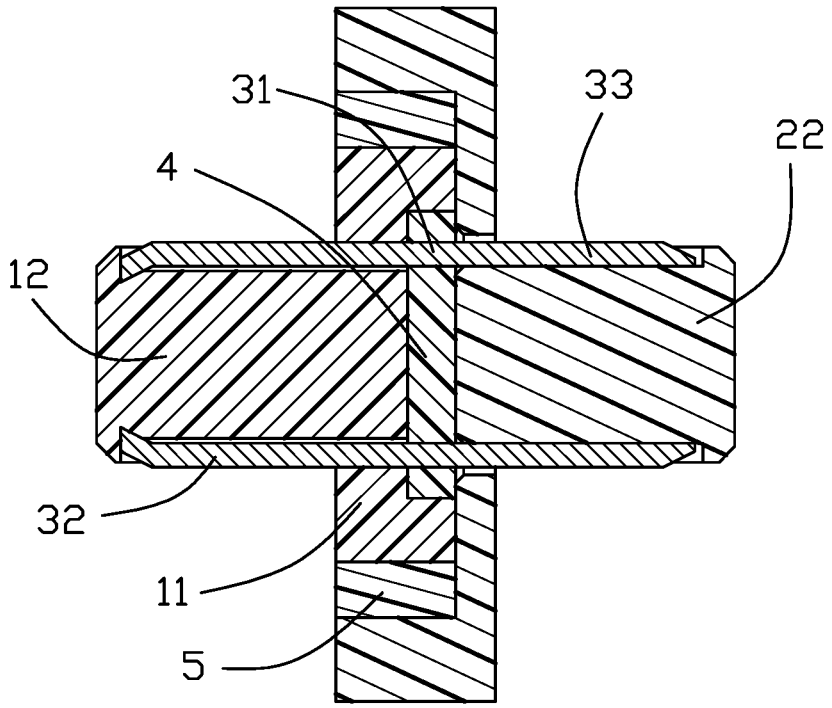
FIG. 9 is a cross-sectional view of the hermetic electrical adaptor of FIG. 1.

Referring to FIGS. 1-9, a hermetic electrical adaptor 100 for connecting two opposite mating connectors (not shown), includes a first insulative body 1, a second insulative body 2, a plurality of contacts 3 disposed on the first insulative body 1 and the second insulative body 2, a plate like first glue body 4 attached to the first insulative body 1, and a frame like second glue body 5 attached between the first insulative body 1 and the second insulative body 2.

The first insulative body 1 includes a first base 11 and a first tongue or first mating port 12 extending forwardly from the first base 11. A receiving space 13 is formed in a back side of the first base 11 opposite to the first tongue 12 in a front-to-back direction. The second insulative body 2 includes a second base 21, a second tongue or second mating port 22 extending forwardly from the second base 21. A receiving cavity 23 is formed in a back side of the second base 21 opposite to the second tongue 22. A plurality of passageways 20 are formed in the second insulative body 2. A pair of securing pieces 24 are formed at two opposite ends of the second insulative body 2. The first insulative body 1 and the second insulative body 2 are back to back assembled to each other wherein the first base 11 is received within the receiving cavity 23.

The contact 3 includes a main body 31, a first contacting section 32 and a second contacting section 33 respectively located at two opposite end regions of the main body 31 wherein the first contacting section 32 is located upon the first tongue 12 and the second contacting section 33 is located upon the second tongue 22. The first insulative body 1 is integrally formed with the contacts 3 via an insert-molding process to have the first contacting sections 32 attached upon the first tongue 11 so as to wholly form a so-called contact module. The first glue body 4 initially in fluidity is applied into the receiving space 13 and successively solidified so as to seal gaps between the contact 3 and the first insulative body 1 for preventing humidity invasion along the front-to-back direction, thus assuring waterproofing. Notably, the contacts 3 extend through the first glue body 4 along the front-to-back direction.

During assembling the contact module including the first insulative body 1 and the associated contacts 3 to the second insulative body 2 in a back-to-back manner to have the first tongue 12 and the second tongue 22 extend away from each other in the front-to-back direction, the first base 11 is received within a center portion of the receiving cavity 23 and the second contacting sections 33 of the contacts 3 are received within the corresponding passageways 20 and exposed upon the second tongue 22. The second glue body 5 initially in fluidity is applied into the peripheral region of the receiving cavity 23 and successively solidified to surround the first base 11 so as to seal gaps between the first base 11 and the second base 21 for preventing humidity invasion along the front-to-back direction, thus assuring waterproofing.

Accordingly, via both the first glue body 4 and the second glue body 5, the whole adaptor 100 performs a superior waterproof effect along the front-to-back direction so as to assure the reliable function on both the first tongue 12 and the second tongue 22. Notably, in this embodiment, the first glue body 4 is flush with the rear face of the first base 11 while the second glue body 5 is flush with both the front face and the rear face of the first base 11. In addition, the front face of the first base 11 is flush with a rear face of the second base 21. In this embodiment, the contacts 3 are arranged in two rows respectively exposed upon two opposite mating surfaces of the first tongue 12 and the second tongue 22.

Figure 10:
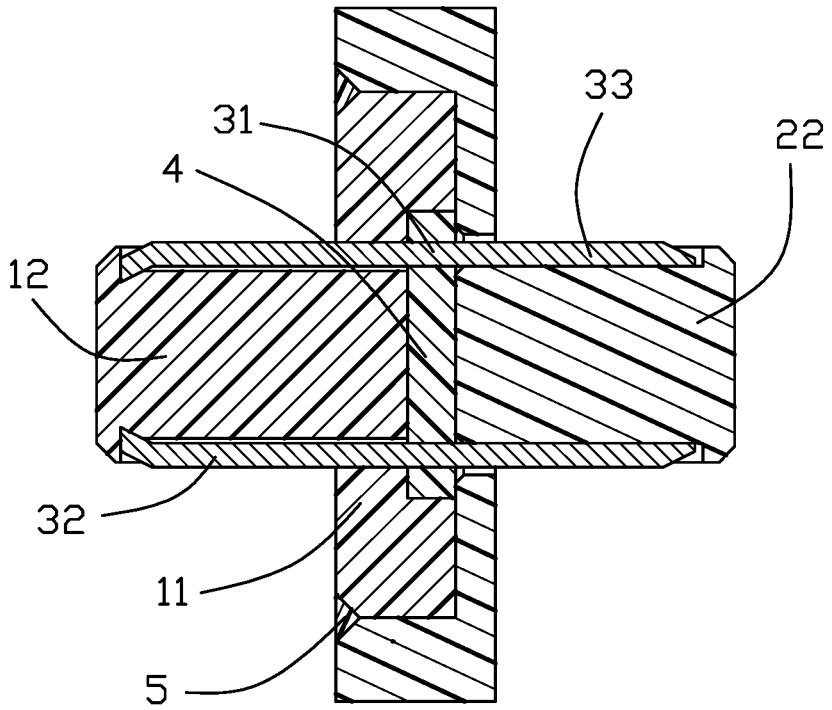
FIG. 10 is a cross-sectional view of the hermetic electrical adaptor according to a second embodiment of the invention.
Figure 11:
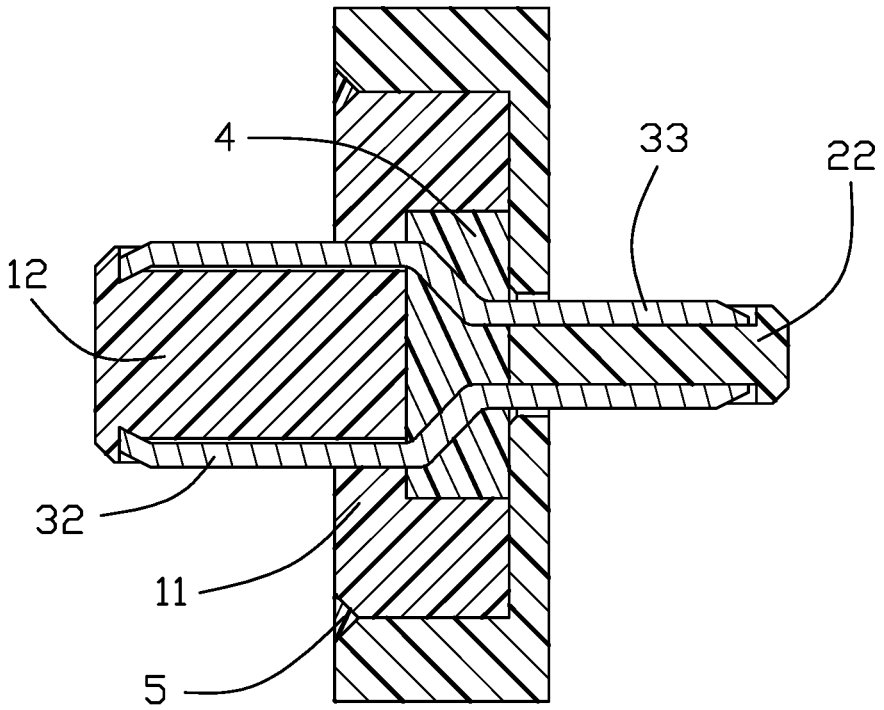
FIG. 11 is a cross-sectional view of the hermetic electrical adaptor according a third embodiment of the invention.
Figure 12:
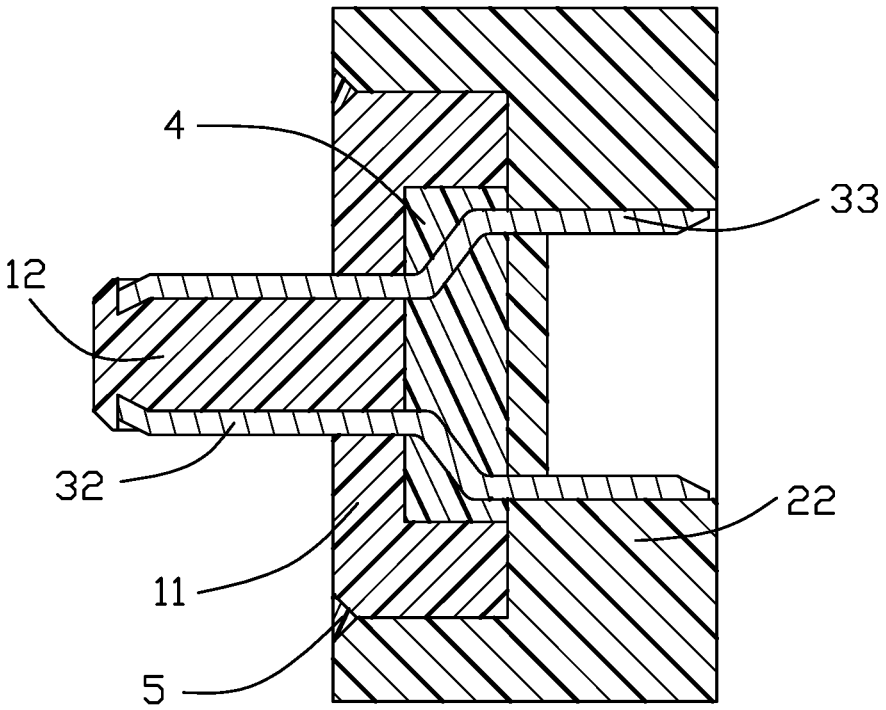
FIG. 12 is a cross-sectional view of the hermetic electrical adaptor according a fourth embodiment of the invention.

FIG. 10 shows another embodiment wherein the second glue body 5 is essentially of a tiny ring configuration with a triangular cross-section thereof. FIG. 11 shows another embodiment wherein a thickness of the second tongue 22 is smaller than that of the first tongue 12 so as to have an offset structure between the first contacting section 32 and the second contacting section 33 of each contact 3. FIG. 12 shows another embodiment wherein the second tongue is replaced with a socket type mating port in which the second contacting section 33 is inwardly, rather than outwardly, exposed in the vertical direction.

In brief, the invention is to provide a hermetic electrical adaptor having an insulative housing defining two mating ports at two opposite ends/sides in the front-to-back direction for connecting two opposite mating connectors wherein a waterproofing glue body seals gaps between the insulative housing and the contacts. The insulative housing may include two bodies assembled together, and the glue body is sandwiched between these two bodies in the front-to-back direction in an embedded manner, and another waterproofing glue body seals gaps between these two bodies.

What is claimed is:

1. An electrical adaptor for connecting opposite two electrical connectors, comprising:

a first insulative body including a first base and a first tongue extending forwardly from the first base in a first horizontal direction;

a second insulative body including a second base and a second tongue extending from the second base in a second horizontal direction opposite to the first horizontal direction;

two rows of contacts each having a main body integrally formed with the first insulative body via insert-molding, and having corresponding opposite first and second contacting sections respectively located at two opposite end regions of the main body and exposed upon the corresponding first tongue and second tongue; and a first waterproofing glue body occupies a receiving space in the first insulative body, and the contacts extend through said glue body; wherein said first waterproofing glue body is sandwiched between the first base and the second base in the first horizontal direction.

2. The electrical adaptor as claimed in claim 1, wherein said first waterproofing glue body is fully embedded within a combination of the first insulative body and the second insulative body without exposure to an exterior.

3. The electrical adaptor as claimed in claim 1, wherein said first insulative body and said second insulative body are back to back assembled to each other so as to hide the first waterproofing glue body.

4. The electrical adaptor as claimed in claim 3, further including a second waterproofing glue body to seal gaps between the first base and the second base.

5. The electrical adaptor as claimed in claim 4, wherein the second waterproofing glue body is of a frame like structure.

6. The electrical adaptor as claimed in claim 3, wherein the second waterproofing glue body is exposed to an exterior while the first waterproofing glue body is fully hidden with a combination of the first insulative body and the second insulative body.

7. The electrical adaptor as claimed in claim 3, wherein the second base forms a receiving cavity in which the first base is disposed.

8. A method for making an electrical adaptor comprising steps of:

providing a contact module with a plurality of contacts integrally formed within a first insulative body wherein the first insulative body forms a first mating port on which the contacts are exposed, and a receiving space, opposite to the first mating port in a horizontal direction, through which the contacts extend in the horizontal direction;

filling said receiving space with a fluidal waterproofing glue body and solidifying said waterproofing glue body;

providing a second insulative body with a plurality of passageways and a second mating port communicating with the passageways; and assembling the contact module to the second insulative body in a back-to-back manner to have the first mating port and the second mating port opposite away from each other in the horizontal direction and to have the contacts extend into the corresponding passageways and exposed upon the second mating port; wherein the waterproofing glue body is embedded within a combination of said first insulative body and said second insulative body, and the contacts extend through said waterproofing glue body in said horizontal direction.

9. The method as claimed in claim 8, wherein the contact module is assembled to the second insulative body before the waterproofing glue body is completely solidified.

10. The method as claimed in claim 8, wherein the second insulative body forms a receiving cavity in which a portion of the first insulative body is received, and further comprising a step of applying another fluidal waterproofing glue body into the receiving cavity to surround the portion of the first insulative body.

11. The method as claimed in claim 8, wherein both said first mating port and said second mating port are tongues.

12. The method as claimed in claim 8, wherein each contact extends in a straight manner.

13. An electrical adaptor for connecting opposite two electrical connectors, comprising:

a first insulative body including a first base and a first tongue extending forwardly from the first base in a first horizontal direction;

a second insulative body including a second base and a second tongue extending from the second base in a second horizontal direction opposite to the first horizontal direction;

two rows of contacts each having a main body integrally formed with the first insulative body via insert-molding, and having corresponding opposite first and second contacting sections respectively located at two opposite end regions of the main body and exposed upon the corresponding first tongue and second tongue; and a first waterproofing glue body occupies a receiving space in the first insulative body, and the contacts extend through said glue body; wherein said first insulative body and said second insulative body are back to back assembled to each other so as to hide the first waterproofing glue body.

14. The electrical adaptor as claimed in claim 13, further including a second waterproofing glue body to seal gaps between the first base and the second base.

15. The electrical adaptor as claimed in claim 14, wherein the second waterproofing glue body is of a frame like structure.

16. The electrical adaptor as claimed in claim 13, wherein the second waterproofing glue body is exposed to an exterior while the first waterproofing glue body is fully hidden with a combination of the first insulative body and the second insulative body.

17. The electrical adaptor as claimed in claim 13, wherein the second base forms a receiving cavity in which the first base is disposed.

* * * * *